US006082986A

United States Patent [19]

Seward et al.

[11] Patent Number: 6,082,986

[45] Date of Patent: Jul. 4, 2000

[54] REVERSIBLE DOUBLE-THROW AIR MOTOR

[75] Inventors: David R. Seward; Paul A. Biek, both of Houston, Tex.

[73] Assignee: Cooper Technologies, Houston, Tex.

[21] Appl. No.: 09/136,301

[22] Filed: Aug. 19, 1998

[51] Int. Cl.[7] ..... F01C 21/00

[52] U.S. Cl. ..... 418/270; 418/268

[58] Field of Search ..... 418/270, 268

[56] References Cited

U.S. PATENT DOCUMENTS

| | | | |
|---|---|---|---|
| Re. 33,711 | 10/1991 | Ono et al. . | |
| 1,931,167 | 10/1933 | Price et al. . | |
| 2,159,232 | 5/1939 | Shaff | 418/82 |
| 2,233,163 | 2/1941 | Fosnot . | |
| 2,257,893 | 10/1941 | Sittert et al. . | |
| 2,339,530 | 1/1944 | Sittert et al. . | |
| 2,401,190 | 5/1946 | Reynolds | 418/270 |
| 2,575,524 | 11/1951 | Mitchell | 418/270 |
| 2,580,631 | 1/1952 | Whitledge . | |
| 2,733,687 | 2/1956 | Schmid | 418/82 |
| 3,088,445 | 5/1963 | Gardner . | |
| 3,093,360 | 6/1963 | Krouse . | |
| 3,232,173 | 2/1966 | Sittert et al. | 418/82 |
| 3,238,848 | 3/1966 | Bent | 418/82 |
| 3,429,230 | 2/1969 | Quackenbush . | |
| 3,439,422 | 4/1969 | Doeden et al. . | |
| 3,453,936 | 7/1969 | Biek et al. | 418/82 |
| 3,463,052 | 8/1969 | Matson | 418/82 |
| 3,556,230 | 1/1971 | Roggenburk . | |
| 3,596,718 | 8/1971 | Fish et al. . | |
| 3,608,649 | 9/1971 | Roggenburk . | |
| 3,614,275 | 10/1971 | Eibsen . | |
| 3,640,351 | 2/1972 | Coyne et al. . | |
| 3,700,363 | 10/1972 | Sorensen et al. . | |
| 3,739,659 | 6/1973 | Workman, Jr. . | |
| 3,760,887 | 9/1973 | Palauro . | |
| 3,791,149 | 2/1974 | Strecker et al. . | |
| 3,791,459 | 2/1974 | Workman, Jr. . | |
| 3,827,834 | 8/1974 | Kakimoto . | |
| 3,833,068 | 9/1974 | Hall . | |
| 3,842,507 | 10/1974 | Boucher . | |
| 3,862,813 | 1/1975 | Strecker et al. . | |
| 3,865,520 | 2/1975 | Kramer et al. | 418/82 |
| 3,904,305 | 9/1975 | Boyd . | |
| 3,908,768 | 9/1975 | Hess . | |
| 3,945,098 | 3/1976 | Yascheritsyn et al. . | |
| 3,951,217 | 4/1976 | Wallace et al. . | |
| 3,960,035 | 6/1976 | Workman, Jr. et al. . | |
| 3,970,151 | 7/1976 | Workman, Jr. . | |
| 3,989,113 | 11/1976 | Spring, Sr. et al. . | |
| 3,998,130 | 12/1976 | Hirmann . | |
| 4,004,859 | 1/1977 | Borries . | |
| 4,010,819 | 3/1977 | Ekström et al. . | |

(List continued on next page.)

FOREIGN PATENT DOCUMENTS

| | | |
|---|---|---|
| 30378 | 11/1959 | Finland . |

*Primary Examiner*—Thomas Denion
*Assistant Examiner*—Theresa Trieu
*Attorney, Agent, or Firm*—Coats & Bennett, P.L.L.C.

[57] ABSTRACT

A reversible double-throw air motor provides for forward and reverse operation by having a cylinder member rotate relative to a stationary valve plate between fixed forward and reverse positions of the cylinder member. The valve plate has diametrically opposite pressure ports and diametrically opposite exhaust ports at an end surface that faces the cylinder member. The cylinder member has a transfer passage associated with each quadrant of the inner surface, the transfer passages opening at wall ports at the inner surface close to each of the two bottom dead center lines. In the forward position of the cylinder, pressure is supplied from the pressure ports in the valve plate through two of the transfer passages to opposite quadrants while the other two quadrants are open to the exhaust ports in the valve plate. For reverse operation, the cylinder is rotated, which reverses the quadrants open to the pressure and exhaust paths. The transfer passages of the cylinder that are associated with exhaust quadrants in each mode communicate the exhaust quadrants with portions of the valve exhaust ports. Instead of being in a separate valve plate, the pressure and supply ports can be in an end surface of the body of the motor.

31 Claims, 4 Drawing Sheets

U.S. PATENT DOCUMENTS 4,023,627 5/1977 Clapp et al. .
4,062,411 12/1977 Adkins et al. .
4,078,618 3/1978 DePagter et al. .
4,109,735 8/1978 Bent .
4,175,408 11/1979 Kasai et al. .
4,177,024 12/1979 Lohn ..... 418/270
4,243,109 1/1981 Anderson .
4,243,110 1/1981 Clemenson et al. .
4,299,097 11/1981 Shank et al. .
4,320,806 3/1982 Koltermann et al. .
4,344,746 8/1982 Leonard ..... 418/270
4,346,765 8/1982 Workman, Jr. .
4,374,632 2/1983 Wilcox ..... 418/82
4,467,877 8/1984 Koltermann et al. .
4,533,337 8/1985 Schoeps .
4,683,961 8/1987 Schoeps .
4,708,210 11/1987 Rahm .
4,718,500 1/1988 Mori .
4,735,595 4/1988 Schoeps .
4,772,186 9/1988 Pyles et al. .
4,822,264 4/1989 Kettner ..... 418/150
4,838,133 6/1989 Dainin .
4,844,177 7/1989 Robinson et al. .
4,919,022 4/1990 Ono et al. .
5,022,469 6/1991 Westerberg .
5,083,619 1/1992 Giardino et al. .
5,092,410 3/1992 Wallace et al. .
5,094,303 3/1992 Jenne .
5,163,519 11/1992 Mead et al. .
5,172,771 12/1992 Wilson .
5,217,079 6/1993 Kettner et al. .
5,327,636 7/1994 Wilson .
5,377,769 1/1995 Hasuo et al. .
5,544,710 8/1996 Groshans et al. .
5,611,404 3/1997 Biek et al. .
5,626,198 5/1997 Peterson .

FIG. 5
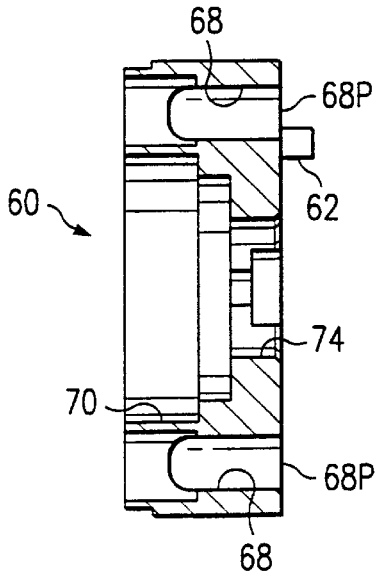
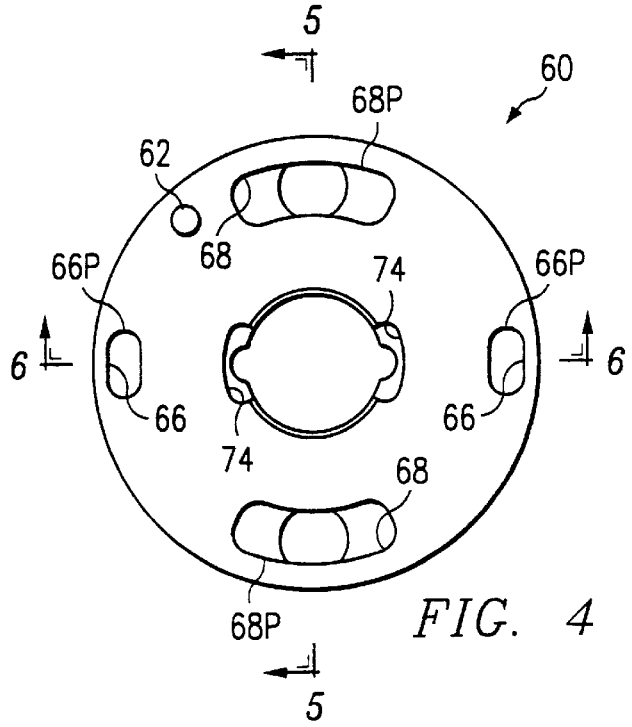
FIG. 4
FIG. 6
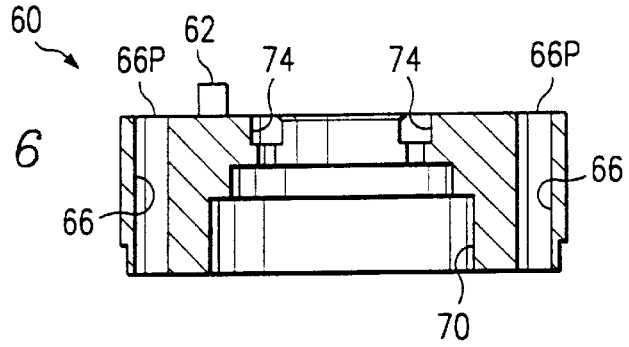
FIG. 7
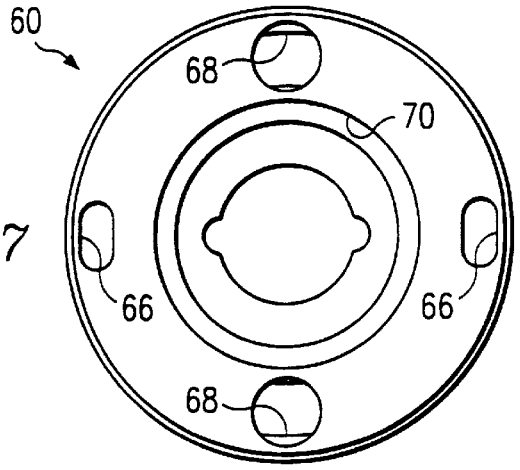

REVERSIBLE DOUBLE-THROW AIR MOTOR

TECHNICAL FIELD OF THE INVENTION

This invention relates generally to pneumatically powered hand tools and more specifically to a motor for use with such tools.

BACKGROUND OF THE INVENTION

Various pneumatic impulse tools, such as impact wrenches, are powered by reversible rotary vane pneumatic motors. Such motors are required to have a large stall torque in both forward and reverse directions. It is advantageous for such motors to be relatively small in size, since they are generally hand-held by an operator.

Most previously known reversible air motors are changed from forward to reverse operation by rerouting the inlet (pressure) and outlet (exhaust) paths at a location remote from the motor package, such as by shuttle spool valves or rotary valves. Such reversing arrangements take up valuable space, making the tool larger, complicate the construction in terms of adding parts and requiring additional labor for assembly, thus increasing the manufacturing cost, and creating tortuous air flow paths, thus reducing efficiency.

Kettner U.S. Pat. No. 4,822,264 (1989) describes and shows a rotary vane air motor in which the supply and exhaust passages leading to and from the cylinder chambers are reversed by changing the rotational position of a rotary valve plate that is positioned between a fixed distributor mounted within the motor casing on a proximal side of the valve plate and a fixed cylinder member on the distal side of the valve plate. Although the design of Kettner's motor improves on some prior art reversible rotary vane motors in terms of size, it has some shortcomings. The distributor has two pressure ports located diametrically opposite each other, each of which is flanked on either side by an exhaust port. The exhaust ports are located very close to the pressure ports, thus presenting an opportunity for blowby of pressure air at the interface between the distributor and the valve plate. That possibility is exacerbated by the fact that the rotatable valve plate interfaces on opposite sides with fixed members with sliding fits. Thus, small tolerance variations can lead to large leaks and reduced efficiency. The position of the valve plate is maintained by a spring/ball detent, and avoiding the risk of an unintended rotation of the valve plate during handling of a tool equipped with the motor requires that the detent be quite strong, which detracts from a desirable facility of reversal by the user. If the valve plate is rotated inadvertently from a desired position during handling, there is no assurance that it will be moved to the proper position during operation of the tool, and the motor performance may be compromised, resulting in a defective operation, such as a low torque on a fastener. The motor/reversal package of the Kettner motor has five main parts—a housing; a cylinder member; a rotor assembly; a distributor; and a valve plate, each of relatively complicated design and calling for precision manufacture to minimize leaks.

SUMMARY OF THE INVENTION

One object of the present invention is to provide a reversible double-throw air motor having a large torque and high rotational acceleration in both forward and reverse operation at slow motor speeds. A further object is to provide such a motor in which the motor package, including the reversing feature, is small in size. Still another object is to make the motor of relatively simple construction with a minimum number of main components, thus reducing the costs for parts and assembly labor. It is also an objective to make the motor easy to use, reliable in operation, durable, and readily cared for.

The foregoing objects can be attained, in accordance with an embodiment of the present invention, by a reversible double-throw air motor having a housing that includes a cavity defined by a peripheral wall and spaced-apart proximal and distal end walls. A tubular cylinder member is mounted in the housing cavity for rotation between a forward position and a reverse position and has an inner surface defining a hole of uniform oblong cross section along its length and having a lengthwise center axis. The inner surface has first, second, third, and fourth quadrants defined by the intersections with the inner surface of mutually perpendicular planes that include the center axis, one of which planes intersects the cylinder inner surface at diametrically opposite bottom dead center lines and the other of which planes intersects the cylinder inner surface at top dead center lines. A rotor is mounted in the housing for rotation about the cylinder center axis and has a circular cylindrical body portion received within the cylinder hole, the peripheral surface of the body portion being in close radial clearance with the inner surface of the cylinder member hole at the bottom dead center lines. The peripheral surface of the rotor, surfaces of the cavity end walls, and the cylinder inner surface define two crescent-shaped chambers. A plurality of circumferentially spaced-apart vanes carried by the rotor body portion for radial displacement toward and away from the cylinder axis and engaging the cylinder inner surface and the cavity end walls divide the two crescent-shaped chambers into a plurality of variable volume rotating working subchambers.

During each revolution of a given vane with the rotor, that vane makes two complete excursions between a bottom dead center position, the position in which the vane is located radially inwardly of one of the two bottom dead center lines of the cylinder inner surface, and a top dead center position, in which the vane is located radially inwardly of one of the two top dead center lines of the cylinder inner surface. During an initial part of each outward excursion, pressurized air is supplied to the cylinder quadrant traversed by the vane. When the next following vane passes bottom dead center, the pressurized air upstream of the vane in question is trapped in the subchamber between the two vanes but continues to expand as the volume in the subchamber increases due to continued outward excursion of the vane in question. When the vane in question passes the top dead center line at the end of the quadrant, the subchamber is opened to exhaust, thus creating a large pressure difference across the next following vane, which has pressurized air trapped in the subchamber behind it. The difference in the pressures in the adjacent subchambers imposes force on the vanes, thus imparting rotational torque to the rotor.

The present invention provides for reversing the direction of operation of the motor by rotating the cylinder between forward and reverse positions relative to pressure and exhaust ports of unique configurations in the proximal end wall of the cavity that receives the cylinder member and by transfer passages and associated ports in the cylinder wall. For purposes of explaining the invention, the four quadrants of the cylinder inner surface are given the numbers one to four, one and three being opposite each other, two being between one and three on one side of the inner surface, and four being between three and one on the other side of the inner surface and the numbers running consecutively in the clockwise direction with respect to the proximal end of the cylinder member. The following is the arrangement of passages and ports:

Exhaust passages in the housing open at a pair of diametrically opposite, circumferentially elongated exhaust ports in the proximal end wall of the cavity. The exhaust ports are positioned and configured to open exclusively to portions of the two crescent-shaped chambers radially inwardly of the second and fourth quadrants, respectively, of the cylinder inner surface when the cylinder member is in the forward position and to open exclusively to portions of the two crescent-shaped chambers radially inwardly of the first and third quadrants, respectively, of the cylinder inner surface when the cylinder member is in the reverse position.

Pressure passages in the housing open at a pair of diametrically opposite pressure ports in the proximal end wall of the cavity radially outwardly of the two crescent-shaped chambers and facing the proximal end surface of the cylinder.

Two diametrically opposite pairs of air transfer passages are provided in the cylinder wall, each transfer passage being associated with one of the four quadrants of the cylinder inner surface. The transfer passages of each pair are closely adjacent to and symmetrically located with respect to one of the bottom dead center lines of the cylinder inner surface and have end ports opening at the proximal end surface of the cylinder, one of which end ports opens to a pressure port in the forward position of the cylinder and the other of which end ports opens to a pressure port in the reverse position of the cylinder. Each transfer passage opens at a wall port at the inner surface of the cylinder member in the quadrant with which that transfer passage is associated. The wall ports are located closely adjacent the bottom dead center lines such that they admit pressurized air to each subchamber immediately after each vane passes a bottom dead center line.

When the cylinder is in the forward position, the following flow paths are established:

- One housing pressure passage open at its pressure port to the cylinder transfer passage associated with cylinder quadrant one (I);
- One housing exhaust passage open at its exhaust port to cylinder quadrant two (II);
- The other pressure passage open at its pressure port to cylinder quadrant three (III); and
- The other housing exhaust passage open at its exhaust port to cylinder quadrant four (IV).

In the above-described forward position of the cylinder, subchambers traversing cylinder quadrants I and III are pressurized and applying torque, and subchambers traversing cylinder quadrants II and IV are connected to exhaust.

When the cylinder member is rotated to the reverse position, the connections of the exhaust and pressure ports in the proximal end wall of the cavity are changed such that cylinder quadrants II and IV are connected to the housing pressure passages by the transfer passages associated with those quadrants, and cylinder quadrants I and III are open to the exhaust ports.

It is possible to configure the pressure and exhaust ports in the proximal end wall of the cavity and the end ports of the transfer passages in the cylinder member such that each of the two transfer passages in the cylinders that are open to the pressure ports in each position of the cylinder are open exclusively to the pressure ports and the other two end ports at the cylinder proximal end surface are blocked off by the proximal end wall of the housing cavity. According to another aspect of the present invention, however, the end ports of the transfer passages in the cylinder member and the exhaust ports at the cavity proximal end wall are dimensioned and configured such that in the forward position of the cylinder member the end ports of the transfer passages associated with the second and fourth quadrants communicate with the exhaust ports by overlapping portions of the exhaust ports and in the reverse position of the cylinder member the end ports of the transfer passages associated with the first and third quadrants communicate with the exhaust ports by overlapping with portions of the exhaust ports. That arrangement allows the exhaust ports to extend circumferentially along only parts of the opposite quadrants of the cylinder inner surface from points close to the top dead lines to points spaced apart from the bottom dead center lines. With that arrangement, exhaust from each subchamber ends before the trailing vane reaches bottom dead center, thus trapping air ahead of the trailing vane. The present invention, in preferred embodiments, provides for exhausting each subchamber downstream from each vane after the trailing vane passes the closure end of each exhaust port through an exhaust connection provided by the non-pressurized end ports of the transfer passages associated with the quadrants that are connected to exhaust. Minimizing trapping of air during the exhaust strokes of the vanes in this manner improves efficiency.

In preferred embodiments of the invention, an operating arm extends from the cylinder member and has a portion accessible from outside the housing that can be engaged by a user to enable the user to move the cylinder member between the forward and reverse positions. A portion of the operating arm extends through a slot in the housing and engages opposite ends of the slot in the forward and reverse positions of the cylinder member, thus stopping the rotation of the cylinder member in the forward and reverse positions. As explained below in connection with the embodiment shown in the drawings, the reaction force due to pressure acting on the cylinder urges the cylinder in a direction opposed to the direction in which the cylinder would be rotated to change the direction of operation of the motor. Thus, the cylinder is inherently held in the operating direction selected by the user and is not apt to move from that position. Should any frictional drag, vibration, or external handling force move the cylinder from the desired or proper position, the reaction pressure forces on the cylinder will immediately rotate the cylinder to the stop position in which the operating arm engages the end of the slot in the housing. The arm and slot provide a simple and effective way to permit changing the direction of operation and maintaining the direction of operation of the motor, once it is selected.

Each of the vanes is, preferably, received in a slot in the rotor with a clearance space between a radially inward end of the vane and a base of the slot. The proximal end wall of the cavity has kick-out slots communicating a pressure passage in the housing with the clearance space of each vane when each vane is located generally radially inwardly of a bottom dead center line of the cylinder inner surface, whereby air pressure in the clearance space acts on each vane to bias it into engagement with the cylinder inner surface.

In preferred embodiments, the housing has a proximal body portion and a distal portion, and the cavity is in the distal portion. The proximal body portion has a pressure supply port adapted to be connected to a source of air pressure and at least one exhaust outlet port. A control valve carried by the proximal body portion of the housing and associated with a portion of the pressure passage intermediate the pressure supply port and the pressure ports in the proximal end wall of the cavity turns the motor on and off and controls the rate of the supply of air and thus the speed of the motor.

Although it is possible to form the pressure and exhaust passages in a single-piece housing body all the way to the distal end wall of the cavity for the cylinder, it is less costly to provide a separate valve plate in the housing, which serves as the proximal end wall of the cavity. The valve plate may also receive a bearing by which the proximal end of the rotor is carried for rotation. The housing receives a distal closure member at the distal end, which serves as the other end wall of the cavity and receives a bearing by which a distal portion of the rotor is carried for rotation.

According to another aspect of the present invention a reversible air motor includes a passageway member having at least one pressure passageway and at least one exhaust passageway. A tubular member is rotatable from a first position to a second position relative to the passageway member. The tubular member has an interior, an inner surface facing the interior, a first port, and a second port. The first port is in communication with the at least one pressure passageway and the second port is in communication with the at least one exhaust passageway when the tubular member is rotated to the first position. The first port is in communication with the at least one exhaust passageway and the second port is in communication with the at least one pressure passageway when the tubular member is rotated to the second position. The reversible air motor also includes a rotor located at least partially in the interior of the tubular member. The rotor has a plurality of vanes. The rotor is rotatable in a first direction when the tubular member is rotated to the first position and in a second direction opposite the first direction when the tubular member is rotated to the second position. The vanes abut against the interior surface when the rotor rotates.

According to a preferred embodiment, the interior has an oblong cross-section, and the passageway member is a valve plate that receives a portion of the rotor and abuts against the tubular member. The tubular member is thus rotatable relative to the valve plate. The housing of the reversible motor may define the tubular member, or a separate tubular member can be received by a cavity in a separate housing. Additionally, an can be arm connected to the tubular member for manually rotating the tubular member to the first and second positions.

According to a further aspect of the present invention, the passageway member includes a kick-out slot for transferring air to an underside of the vanes.

According to another aspect of the present invention a reversible air motor includes an arm that movable from a first position to a second position. A rotor has vanes that are rotatable in a first direction when the arm is moved to the first position. The rotor is also rotatable in a second direction opposite to the first direction when the arm is moved to the second position. The reversible air motor further includes a device for providing a first reaction torque to the arm to bias the arm toward the first position when the rotor is rotating in the first direction and a second reaction torque to the arm to bias the arm toward the second position when the rotor is rotating in the second direction. According to a preferred embodiment, the device for providing the reaction torques includes a tubular member that receives the rotor and that is rotatable from a first position to a second position when the arm is moved from the first position to the second position. A housing having a cavity can receive the rotor and the device for providing the reaction torques.

For a better understanding of the invention, reference may be made to the following description of an exemplary embodiment, taken in conjunction with the accompanying drawings.

BRIEF DESCRIPTION OF THE DRAWINGS

For a more complete understanding of the present invention, and the advantages thereof, reference is now made to the following written description taken in conjunction with the accompanying drawings, in which:

FIGS. 4 to 7 are views of the valve plate, as follows:

FIG. 4 is a view of the distal end;

FIG. 5 is a side cross-sectional view, taken along the lines 5—5 of FIG. 4;

FIG. 6 is a side cross-sectional view, taken along the lines 6—6 of FIG. 4; and FIG. 7 is a view of the proximal end;

FIG. 8 is view of the proximal end;

FIG. 9 is a side cross-sectional view, taken along the lines 9—9 of FIG. 8;

FIG. 10 is a side elevational view;

FIG. 11 is a view of the distal end;

DETAILED DESCRIPTION OF THE INVENTION

Figure 1:
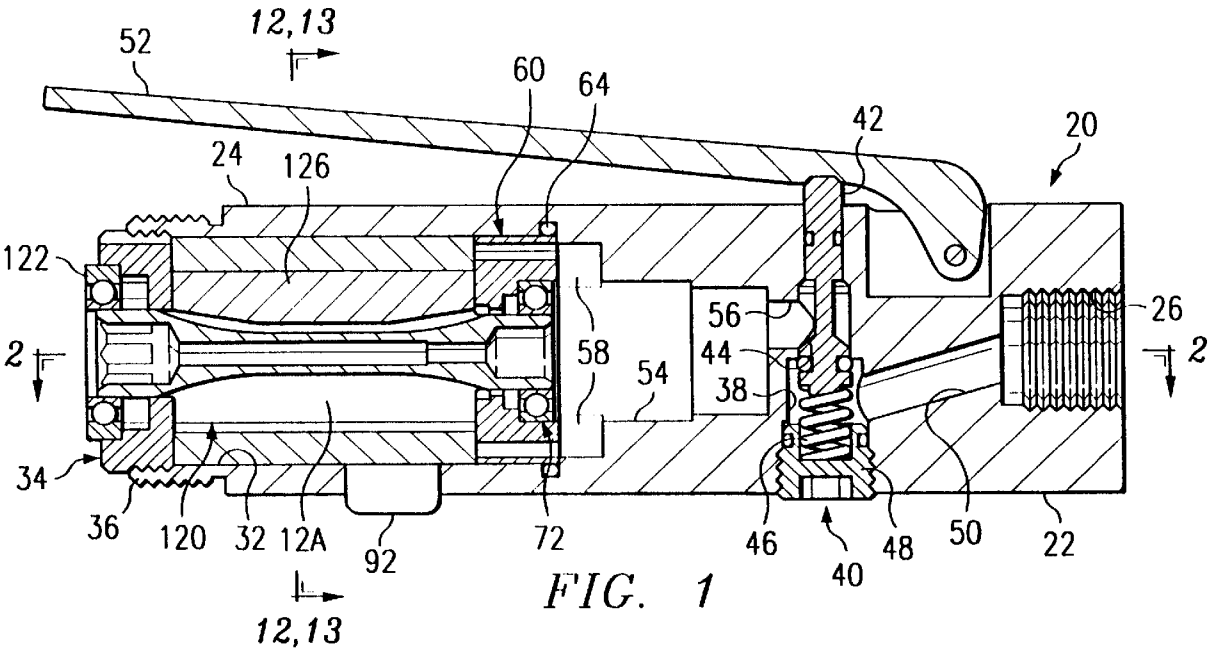
FIG. 1 is a side cross-sectional view of the embodiment, taken along the lines 1—1 of FIG. 3.
Figure 2:
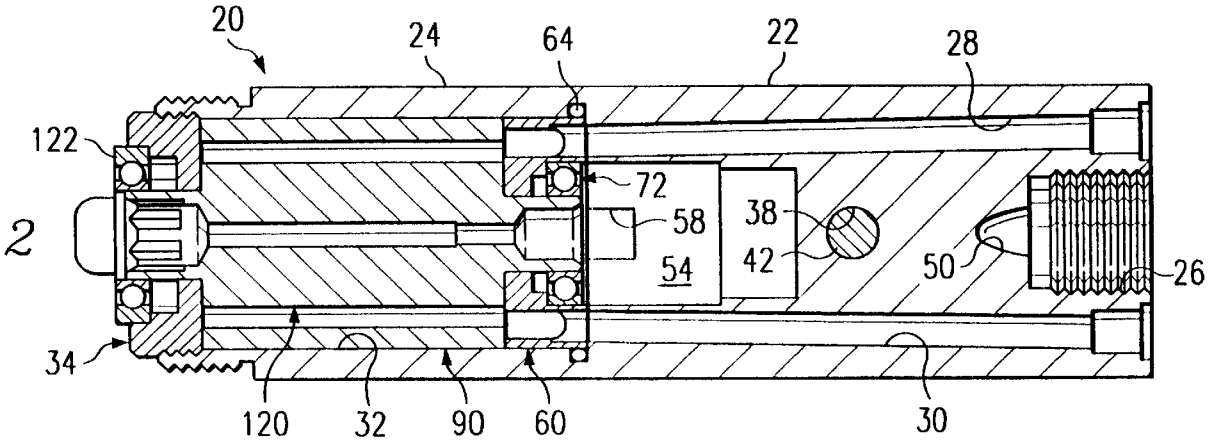
FIG. 2 is a top cross-sectional view of the embodiment, taken along the lines 2—2 of FIG. 3 of the embodiment.
Figure 3:
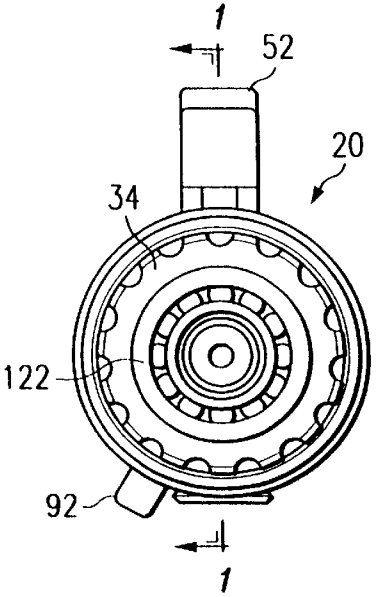
FIG. 3 is an end elevational view.
Figure 14:
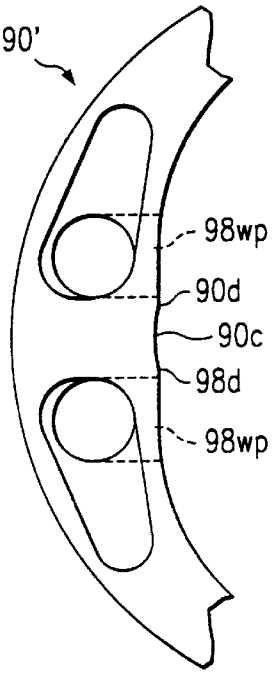
FIG. 14 is a partial end elevational view of a portion of a cylinder of a modified configuration.
Figure 11:
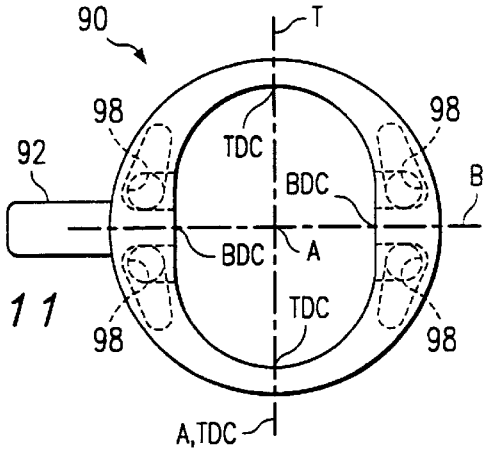
FIGS. 8 to 11 are views of the cylinder member, as follows.
Figure 10:
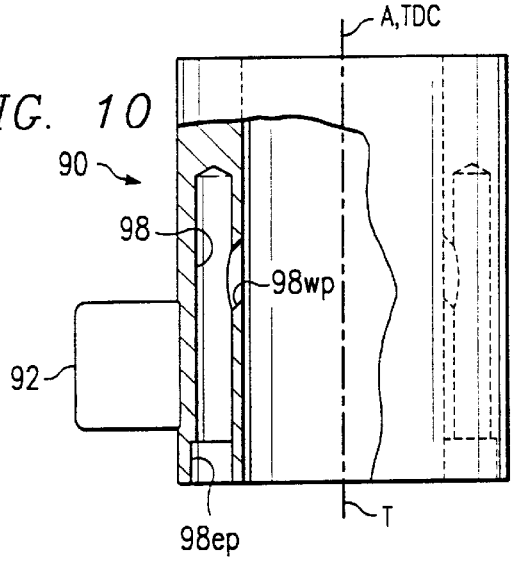
Figure 9:
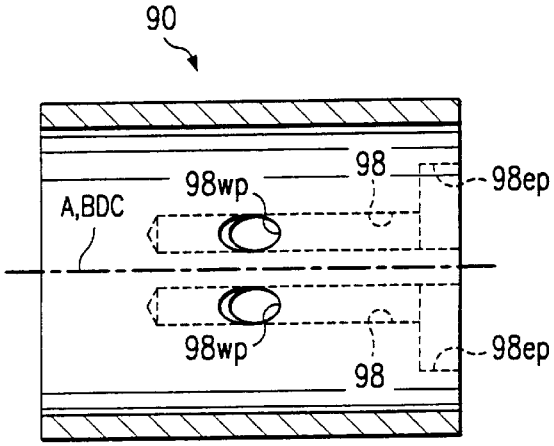
Figure 8:
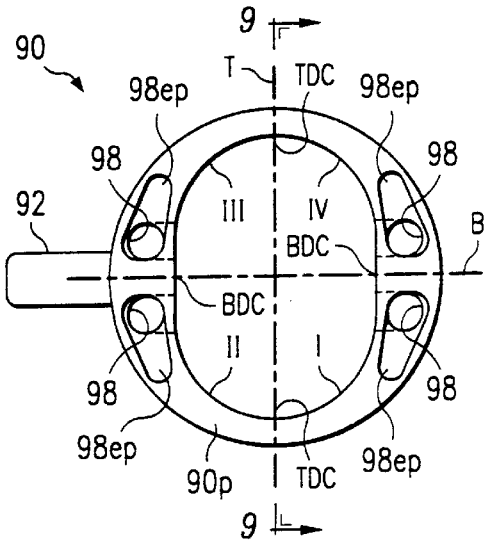

A preferred embodiment of the present invention and its advantages are best understood by referring to FIGS. 1 through 14 of the drawings, like numerals being used for like and corresponding parts of the various drawings.

A housing 20 has a proximal body portion 22 and a distal portion 24. A threaded socket 26 in the proximal end of the body accepts a coupling (not shown), by which the motor is connected to an air hose (not shown) that supplies air under pressure from a source (not shown). Two exhaust passages 28 and 30 extend along the sides of the proximal body portion 22 from the proximal end and lead distally to a valve plate 60, which serves as the end wall of a cavity 32 in the distal portion 24 of the housing. An end closure 34 threads into the distal end of a peripheral wall portion 36 of the housing and provides the distal end wall of the cavity 32.

A transverse stepped bore 38 in the proximal body portion 22 receives a spring-loaded poppet valve assembly 40. A valve body 42 is biased to a closed position against a seat 44 by a spring 46. A plug 48 threaded into the bore 38 closes the bore and provides a seat for the spring. A pressure passage 50 leads to the upstream side of the valve assembly 40 from the socket 26. When the valve is opened, by squeezing a lever 52 that engages valve body 42, air under pressure flows through the valve into a stepped bore 54 from an exit passage 56 adjacent valve seat 44. Lateral grooves 58 on opposite sides of the stepped bore 54 present pressurized air to diametrically opposite side portions of valve plate 60.

The valve plate 60 (FIGS. 4 to 7) is received in the housing bore 54 with a pin 62 (received in a hole in the housing, not shown) to keep the valve plate from rotating and an O-ring 64 (FIG. 1) at its perimeter to hold pressure in the stepped bore 54. A pair of oblong pressure passages 66 open at their proximal ends to notches 58 (see FIG. 1) and thus to the pressure supplied to the housing bore 54 when the control valve 40 is opened; the distal ends form pressure ports 66*p*. A pair of exhaust passages 68 open at their proximal ends to exhaust passages 28 and 30 in the housing body 22. The proximal portions of the exhaust passages are circular; the distal portions are arcuate grooves and present at the distal face (FIG. 4) kidney-shaped exhaust ports 68*p*. An axial stepped bore 70 at the center of the valve plate 60 receives a bearing 72 (FIGS. 1 and 2), by which the proximal end of a rotor 120 is rotatably mounted in the housing. The distal portion of the bore 70 has diametrically opposite notches 74, the distal ends of which are circumferentially elongated. The purpose of notches 74 is described below.

A tubular cylinder member 90 (FIGS. 8 to 11) is received in the cavity 32 in the distal portion 24 of the housing 20 for rotation about a center axis between a forward position and a reverse position. The forward and reverse positions are established by engagement of a radially inner portion of an arm 92 that is accessible from outside with the opposite ends of a slot 94 in the wall of the housing (see FIGS. 12A and 13A).

The outer portion of the arm 92 is accessible for engagement by a user for rotation of the cylinder member 90 to change the direction of operation of the motor. For clarity, the drawings show the arm protruding from the outer surface of the housing. In practice, it is preferable to recess the arm 92 slightly into the housing to minimize the possibility of inadvertent rotation of the cylinder member 90.

The inner surface 96 of the cylinder wall is of uniform, oblong cross section along its axial extent and has two oppositely located bottom dead center positions BDC and top dead center positions TDC, which correspond to the lines of intersection with the inner surface 96 of two mutually perpendicular planes of synmmetry B and D of the inner surface 96 that include the cylinder axis A. The quadrants of the inner surface 96 of the cylinder member 90 between the lines of intersection are labeled I, II, III, and IV in FIGS. 8, 12B and 13B.

Two pairs of transfer passages 98 are formed in the wall of the cylinder member opposite each other in symmetrical relation to the plane T of the top dead center lines TDC. Passages 98 of each pair are symmetrical with respect to the plane B of bottom dead center lines BDC. Each passage opens at a kidney-shaped end port 98*ep* (formed by an arcuate groove portion of the transfer passage) in the proximal end surface 90*p* of the cylinder, which abuts the valve plate 60, and opens at a wall port 98*wp* at the inner surface 96 of the cylinder (formed by a round hole bored obliquely to the plane of the TDC lines and parallel to the planes of the BDC lines). The wall ports 98*wp* are closely spaced apart from each other and equidistant from the BDC lines.

The rotor 120 is carried by a bearing 72 in the valve plate 60 and a bearing 122 in the housing end closure 34 for rotation about the axis A of the cylinder member 90. A circular cylindrical body portion 120*b* of the rotor is received within the cylinder with its peripheral surface in close running clearance with the inner surface 96 of the cylinder member 90 and its end surfaces in close running clearance with the surface of the valve plate 60 and the end closure 34 that define the cavity 32. The inner surface 96 of the cylinder member 90, the surfaces of the end plate 60 and the closure member 32 facing the hole in the cylinder member 90, and the peripheral surface of the rotor body portion define two crescent-shaped chambers (see, e.g., FIG. 12A).

The body portion 120*b* of the rotor 120 shown in the drawings has six circumferentially spaced-apart radial slots 124, each of which extends the full length of the body portion 120*b* and receives a vane 126 for radial sliding displacement (only one vane is shown in the drawings). Segments of the inner surface 96 of the cylinder member 90 and the rotor body 120*b*, the distal surface of valve plate 60, and the proximal surface of end closure 34 between each adjacent pair of vanes 126 define subchambers of the two crescent-shaped chambers. The number of vanes may be varied from four to nine or more, odd numbers being preferred for eliminating what in any case is a small chance of the motor not starting if the rotor should stop with two vanes at bottom dead center. If that were to happen in a motor with an even number of vanes, the user can rotate cylinder member 90 slightly to reposition the BDC lines relative to the vanes momentarily when starting the motor.

The inner edges of the vanes 126 are in radial clearance from the bases of the slots 124 at BDC (and, of course, in all circumferential positions). Kick-out slots or notches 74 in the valve plate 60 allow pressurized air to flow from the housing bore 54 into the clearance space and bias the vanes 126 outwardly into engagement with the inner surface of the cylinder walls. The kick-out slots 74 are positioned circumferentially to be opposite the initial part of each working stroke of each subchamber of the motor to apply kick-out pressure just after each vane 126 passes BDC.

Figure 12A:
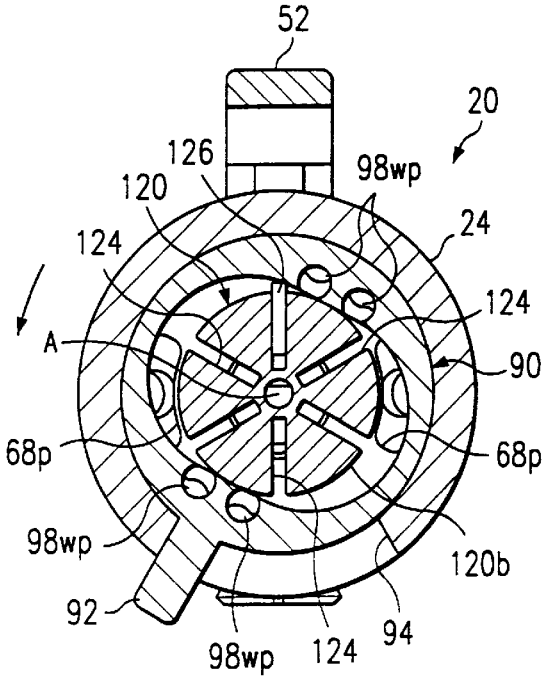
FIGS. 12A and 13A are end cross-sectional views taken along the lines 12,13—12,13 of FIG. 1 and show the motor in the forward and reverse positions, respectively.
Figure 12B:
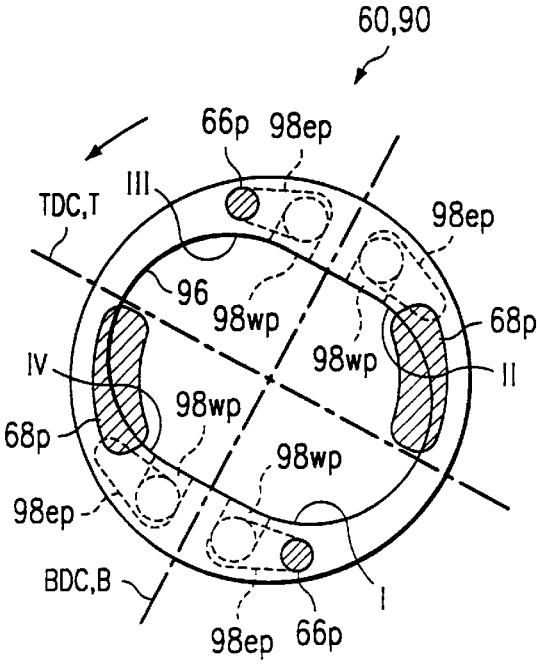
FIGS. 12B and 13B are schematic diagrams of the parts in the forward and reverse positions, respectively.
Figure 13A:
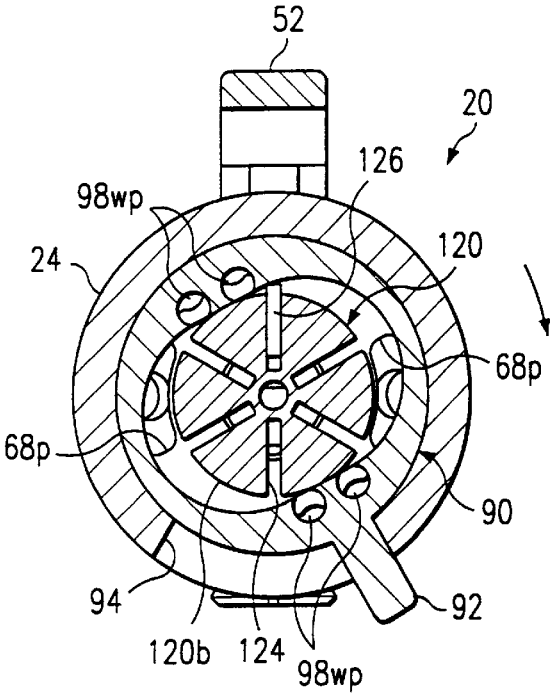
Figure 13B:
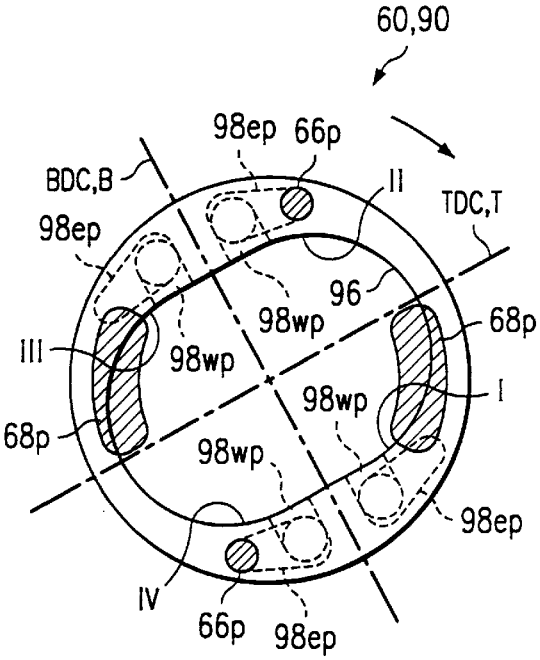

To operate the motor in forward mode, the user engages the arm 92 and rotates the cylinder member 90 to the position shown in FIGS. 12A and 12B. The following states and flow paths are set up with the cylinder member in that position:

- Quadrant I—Pressure—cylinder end port 98*ep* (kidney-shaped) open to valve plate pressure port 66*p*—quadrant I is pressured from end port 98*ep* through the transfer passage to cylinder wall port 98*wp*;
- Quadrant II—Exhaust—cylinder end port 98*ep* (kidney-shaped) open to valve plate exhaust port 68*p*—quadrant II exhausts from wall port 98*wp* through the transfer passage to 98*ep* and exhausts directly through the exhaust port 68*p* in the valve plate;
- Quadrant III—Pressure—cylinder end port 98*ep* (kidney-shaped) open to valve plate pressure port 66*p*—quadrant III is pressured from end port 98*ep* through the transfer passage to cylinder wall port 98*wp*; and
- Quadrant IV—Exhaust—cylinder end port 98*ep* (kidney-shaped) open to valve plate exhaust port 68*p*—quadrant IV exhausts from the wall port 98*wp* through transfer passage to 98*ep* and exhausts directly through exhaust port 68*p*.

When the control valve 42 is opened, any vane 126 that is counterclockwise (with respect to FIG. 12) of the BDC line and in quadrant I or III is subjected to pressure, which produces a counterclockwise torque on the rotor 120. (Inasmuch as FIGS. 12 and 13 are from the distal end, the rotation with respect to the proximal end is clockwise, which is conventionally considered a forward rotation for most rotary tools.) As each vane in succession passes a BDC line and enters quadrant I or III, it becomes subject to pressure and produces torque. As each vane passes a TDC line and enters quadrant II or IV, the subchamber upstream from it is opened to exhaust (see above). Accordingly, all of the subchambers are sequentially subject to pressure and exhaust, thus producing differential pressures across each vane twice in each revolution made by that vane.

When the user wants to operate the motor in reverse rotation, he or she moves the arm 92 to the position shown in FIG. 13. The reader will see from FIG. 13 that the states and connections of the quadrants that prevail in the forward mode, as described above and shown in FIG. 12, are reversed—quadrants II and IV are pressure quadrants, and quadrants I and III are exhaust quadrants. Thus, the rotor is driven clockwise with respect to FIG. 13—counterclockwise, with respect to the proximal end.

In both forward and reverse modes of operation, the cylinder member 90 is subject to a reaction torque equal and opposite to the driving torque imposed on the rotor 120—the pressures in the subchambers want to squeeze the cylinder member in a direction opposite from the direction of rotation of the rotor. The reaction torque on the rotor in both modes is transmitted by arm the 92 to the end of slot 94 in the housing. Thus, when the motor is operating, the chance of it changing from one mode to the other is small because of the reaction torque. Also, when the motor is not operating, any dislocation of the cylinder member will be immediately corrected by the reaction torque when the motor is started. The motor can, if desired, be provided with a spring detent between the rotor and the cylinder member, primarily to provide a clicking sound that will tell the user that an operating (forward or reverse) position has been attained.

End ports 98*ep* at the end surface of cylinder member 90 are kidney-shaped so that the wall thickness of the cylinder member can be kept small and machining is easier to set up for. With the thin wall, a straight hole from the end port to the wall port would break through the cylinder wall between the ports. It would be possible with a thicker cylinder wall to drill straight circular transfer passages obliquely to both the center axis A and the bottom dead center plane BDC. One advantage of the configurations of the passages and ports of the embodiment is that the diameter of the motor can be relatively small and the weight low for easier handling by the user and a low starting inertia.

The shape of the oblong hole in the cylinder member can vary in geometry. Also, as shown in FIG. 17, the hole of a cylinder member 90' may have concavities, the curvatures of which are equal to the curvature of the rotor body 120*b*. Each concavity is flanked by a cusp 90*d*. The concavities may improve efficiency by reducing blowby at the BDC points where the rotor 120 is in running clearance with the cylinder wall. The concavities 90*c* lengthen the circumferential distance for running of the rotor body closely along the wall of the cylinder from essentially a line (see FIGS. 12A and 13A) to several degrees of rotation of the rotor.

In many, and perhaps most, applications of rotary vane air motors, a governor is included. A suitable governor, many designs for which are well-known, may be installed in the larger diameter portion of the stepped bore 54 of the body 20. The tools driven by the type of motor to which the present invention relates often have adjustable torque shut-off mechanism, which are coupled by a push rod to a valve located between the operating valve (40) and the motor package. The above-described embodiment makes provision for the push rod of a torque shut-off mechanism by including an axial hole through the rotor 120. The torque-shut off valve can be located in the reduced diameter portion of the bore 54 adjacent the pressure passage 56 leading from the operating valve 40.

The embodiment is configured in an "in-line" form, in which the body 20 is generally cylindrical and is grasped in the hand of the user. The housing can be configured as a "pistol." A pistol tool using a motor package according to the present invention can have radial exhaust passages in the body, which can be located radially outwardly of the valve plate 60. The valve plate (or the motor body in a case where passages and ports serving the cylinder/rotor are in the housing rather than in a separate valve plate) will then have exhaust ports at a circumferential surface rather than a transverse surface (or passages leading parallel to the axis), as in the embodiment.

Although the present invention and its advantages have been described in detail, it should be understood that various changes, substitutions and alterations can be made herein without departing from the spirit and scope of the invention as defined by the following claims.

What is claimed is:

1. A reversible double-throw air motor, comprising a housing having a cavity defined by a peripheral wall and spaced-apart proximal and distal end walls;

a tubular cylinder member mounted in the housing cavity for rotation between a forward position and a reverse position and having an inner surface defining a hole of uniform oblong cross section along its length and having a lengthwise center axis, the inner surface having first, second, third, and fourth quadrants defined by intersections with the inner surface of mutually perpendicular planes that include the center axis, one of which planes intersects the cylinder inner surface at diametrically opposite bottom dead center lines and the other of which planes intersects the cylinder inner surface at top dead center lines;

a rotor mounted in the housing for rotation about the cylinder center axis and having a circular cylindrical body portion received within the cylinder hole, the peripheral surface of the body portion being in close running radial clearance with the inner surface of the cylinder member hole at the bottom dead center lines, and the peripheral surface of the rotor, surfaces of the cavity end walls, and the cylinder inner surface defining two rotating crescent-shaped chambers;

a plurality of circumferentially spaced-apart vanes carried by the rotor body portion for radial displacement toward and away from the cylinder axis and engaging the cylinder inner surface and the cavity end walls such as to divide the two rotating crescent-shaped chambers into a plurality of variable volume rotating working subchambers;

exhaust passages in the housing opening at a pair of diametrically opposite circumferentially elongated exhaust ports in the proximal end wall of the cavity, the exhaust ports being positioned and configured to open exclusively to portions of the two crescent-shaped chambers radially inwardly of the first and third quadrants of the cylinder inner surface when the cylinder member is in the forward position and to open exclusively to portions of the two crescent-shaped chambers radially inwardly of the second and fourth quadrants of the cylinder inner surface when the cylinder member is in the reverse position;

pressure passages in the housing opening at a pair of diametrically opposite pressure ports in the proximal end wall of the cavity radially outwardly of the two crescent-shaped chambers in all rotational positions of the rotor and facing an end wall of the cylinder; and two diametrically opposite pairs of air transfer passages in the said tubular cylinder member, each transfer passage being associated with one of the quadrants of the cylinder inner surface, the transfer passages of each pair being closely adjacent to and symmetrically located with respect to one of the bottom dead center lines of the cylinder inner surface and having end ports opening at a proximal end surface of the cylinder, one of which end ports opens to a pressure port in the forward position of the cylinder and the other of which end ports opens to a pressure port in the reverse position of the cylinder, and each transfer passage opening at a wall port at the inner surface of the cylinder member in the quadrant of the cylinder inner surface with which the transfer passage is associated.

2. A reversible double-throw air motor according to claim 1 wherein the end ports of the transfer passages and the exhaust ports are dimensioned and configured such that in the forward position of the cylinder member the end ports of the transfer passages associated with the second and fourth quadrants communicate with the exhaust ports by overlapping portions of the exhaust ports and in the reverse position of the cylinder member the end ports of the transfer passages associated with the first and third quadrants communicate with the exhaust ports by overlapping with portions of the exhaust ports.

3. A reversible double-throw air motor according to claim 1 and further comprising an operating arm extending from the cylinder member and having a portion accessible from outside the housing engageable by a user to enable the user to move the cylinder member between the forward and reverse positions.

4. A reversible double-throw air motor according to claim 3 wherein the operating arm extends through a slot in the housing and engages opposite ends of the slot in the forward and reverse positions of the cylinder member, thus stopping the rotation of the cylinder member in the forward and reverse positions.

5. A reversible double-throw air motor according to claim 1 wherein each of the vanes is received in a slot in the rotor with a clearance space between a radially inward end of the vane and a base of the slot, and the proximal end wall of the housing has kick-out slots communicating a pressure passage in the housing with the clearance space of each vane when each vane is located generally radially inwardly of a bottom dead center line of the cylinder inner surface, whereby air pressure in the clearance space acts on each vane to bias it into engagement with the cylinder inner surface.

6. A reversible double-throw air motor according to claim 1 wherein the housing has a proximal body portion and a distal portion, the cavity is in the distal portion, the proximal body portion has a pressure supply port adapted to be connected to a source of air pressure and at least one exhaust outlet port.

7. A reversible double-throw air motor according to claim 6 and further comprising a control valve carried by the body portion of the housing and associated with a portion of the pressure passage intermediate the pressure supply port and the pressure ports in the proximal end wall of the cavity.

8. A reversible double-throw air motor according to claim 1 wherein the housing has a proximal body portion and a distal portion, the cylinder member is received in the distal portion, the housing includes a separate valve plate received adjacent a proximal portion of the cylinder member, the proximal end wall of the housing being a wall of the valve plate.

9. A reversible double-throw air motor according to claim 8 wherein the valve plate receives a bearing by which a proximal end of the rotor is carried for rotation.

10. A reversible double-throw air motor according to claim 8 wherein the housing receives a distal closure member in a distal end of the distal portion, the distal end wall of the cavity is a wall of the distal closure member, and the distal closure member receives a bearing by which a distal portion of the rotor is carried for rotation.

11. A reversible double-throw air motor, comprising:

a housing having a cavity defined by a peripheral wall and spaced-apart proximal and distal end walls;

a tubular cylinder member mounted in the housing cavity for rotation between a forward position and a reverse position and having an inner surface defining a hole of uniform oblong cross section along its length and having a lengthwise center axis, the inner surface having first, second, third, and fourth geometrically similar quadrants defined by the intersections with the inner surface by mutually perpendicular planes that include the center axis, one of which planes intersects the cylinder inner surface at diametrically opposite bottom dead center lines and the other of which planes intersects the cylinder inner surface at top dead center lines;

a rotor mounted in the housing for rotation about the cylinder center axis and having a circular cylindrical body portion received within the cylinder hole, the peripheral surface of the body portion being in close radial clearance with the inner surface of the cylinder member hole at the bottom dead center lines and the peripheral surface of the rotor, surfaces of the cavity end walls, and the cylinder inner surface defining two crescent-shaped chambers;

a plurality of circumferentially spaced-apart vanes carried by the rotor body portion for radial displacement toward and away from the cylinder axis and engaging the cylinder inner surface and the cavity end walls such as to divide the two crescent-shaped chambers into a plurality of variable volume rotating working subchambers;

exhaust passages in the housing opening at a pair of diametrically opposite circumferentially elongated exhaust ports in the proximal end wall of the cavity, the exhaust ports being positioned and configured to open exclusively to portions of the two crescent-shaped chambers radially inwardly of the second and fourth quadrants of the cylinder inner surface when the cylinder member is in the forward position and to open exclusively to portions of the two crescent-shaped chambers radially inwardly of the first and third quadrants of the cylinder inner surface when the cylinder member is in the reverse position;

pressure passages in the housing opening at a pair of diametrically opposite pressure ports in the proximal end wall of the cavity radially outwardly of the two crescent-shaped chambers and facing an end wall of the cylinder; and two diametrically opposite pairs of air transfer passages in the said tubular cylinder member, each transfer passage being associated with one of the quadrants of the cylinder inner surface, the transfer passages of each pair being adjacent to and symmetrically located with respect to one of the bottom dead center lines of the cylinder inner surface, each transfer passage opening at a wall port on the cylinder inner surface in the quadrant of the cylinder inner surface with which that transfer passage is associated and opening at end ports at the cylinder end wall, the end ports of the transfer passages being circumferentially elongated and dimensioned and oriented such that:

in the forward position of the cylinder member the end ports of the transfer passages associated with the first and third quadrants communicate with the pressure ports and the end ports of the transfer passages associated with the second and fourth quadrants communicate with the exhaust ports by overlapping portions of the exhaust ports, and in the reverse position of the cylinder member the end ports of the transfer passages associated with the second and fourth quadrants communicate with the pressure ports and the end ports of the transfer passages associated with the first and third quadrants communicate with the exhaust ports by overlapping portions of the exhaust ports that face the cylinder proximal end surface.

12. A reversible double-throw air motor according to claim 11 and further comprising an operating arm extending from the cylinder member and having a portion accessible from outside the housing engageable by a user to enable the user to move the cylinder member between the forward and reverse positions.

13. A reversible double-throw air motor according to claim 12 wherein the operating arm extends through a slot in the housing and engages opposite ends of the slot in the forward and reverse positions of the cylinder member, thus stopping the rotation of the cylinder member in the forward and reverse positions.

14. A reversible double-throw air motor according to claim 13 wherein each of the vanes is received in a slot in the rotor with a clearance space between a radially inward end of the vane and a base of the slot, and the proximal end wall of the housing has kick-out slots communicating a pressure passage in the housing with the clearance space of each vane when each vane is located generally radially inwardly of a bottom dead center line of the cylinder inner surface, whereby air pressure in the clearance space acts on each vane to bias it into engagement with the cylinder inner surface.

15. A reversible double-throw air motor according to claim 13 wherein the housing has a proximal body portion and a distal portion, the cavity is in the distal portion, the proximal body portion has a pressure supply port adapted to be connected to a source of air pressure and at least one exhaust outlet port.

16. A reversible double-throw air motor according to claim 15 and further comprising a control valve carried by the body portion of the housing and associated with a portion of the pressure passage intermediate the pressure supply port and the pressure ports in the proximal end wall of the cavity.

17. A reversible double-throw air motor according to claim 11 wherein the housing has a proximal body portion and a distal portion, the cylinder member is received in the distal portion, and the proximal end wall of the cavity is a separate valve plate received in the distal portion of the housing adjacent the proximal end surface of the cylinder member.

18. A reversible double-throw air motor according to claim 17 wherein the valve plate receives a bearing by which a proximal end of the rotor is carried for rotation.

19. A reversible double-throw air motor according to claim 11 wherein the housing receives a distal closure member in a distal end of the distal portion, the distal end wall of the cavity is a separate distal closure member of the housing, and the distal closure member receives a bearing by which a distal portion of the rotor is carried for rotation.

20. A reversible air motor, comprising:

a passageway member having at least one inlet pressure passageway and at least one exhaust passageway;

a tubular member rotatable from a first position to a second position relative to said passageway member, said tubular member having an interior, an inner surface facing said interior, a first port, and a second port, said first port in communication with said at least one pressure passageway and said second port in communication with said at least one exhaust passageway when said tubular member is rotated to said first position, said first port in communication with said at least one exhaust passageway and said second port in communication with said at least one pressure passageway when said tubular member is rotated to said second position; and a rotor located at least partially in said interior and having a plurality of vanes, said rotor being rotatable in a first direction when said tubular member is rotated to said first position and in a second direction opposite said first direction when said tubular member is rotated to said second position, said vanes abutting against said inner surface when said rotor rotates.

21. The reversible air motor according to claim 20, wherein said interior has an oblong cross-section.

22. The reversible air motor according to claim 20, wherein said passageway member is a valve plate that receives a portion of said rotor and that abuts against said tubular member, said tubular member rotatable relative to said valve plate.

23. The reversible air motor according to claim 20, further comprising a housing having a cavity that receives said tubular member.

24. The reversible air motor according to claim 23, wherein said tubular member is rotatable relative to said housing.

25. The reversible air motor according to claim 20, further comprising an arm connected to said tubular member for manually rotating said tubular member.

26. The reversible air motor according to claim 20, wherein said tubular member includes a third port and a fourth port.

27. The reversible air motor according to claim 20, wherein said passageway member includes a kick-out slot for transferring air to an underside of said vanes.

28. A reversible air motor, comprising:

an arm movable from a first position to a second position;

a rotor having vanes that are rotatable in a first direction when said arm is moved to said first position and a second direction opposite to said first direction when said arm is moved to said second position; and means for providing a first reaction torque to said arm to bias said arm toward said first position when said rotor is rotating in said first direction and a second reaction torque to said arm to bias said arm toward said second position when said rotor is rotating in said second direction.

29. The reversible air motor according to claim 28, wherein said means for providing said reaction torques includes a tubular member that receives said rotor and that is rotatable from a first position to a second position when said arm is moved from said first position to said second position.

30. The reversible air motor according to claim 28, further comprising a housing having a cavity that receives said rotor and said means for providing said reaction torques.

31. A reversible double-throw air motor, comprising:

a housing having a cavity defined by a peripheral wall and spaced-apart proximal and distal end walls;

a cylinder member rotatably mounted in said cavity and having a inner cavity having a lengthwise center axis, said cylinder member rotatable between a first position and a second position;

a rotor mounted at least partially within said inner cavity of said cylinder member for rotation about said center axis;

wherein said rotor rotates in a first direction when said cylinder member is in said first position and in a second direction, opposite from said first direction, when said cylinder member is in said second position.

* * * * *